United States Patent [19]

Füllemann et al.

[11] Patent Number: 4,712,997

[45] Date of Patent: Dec. 15, 1987

[54] BURNER, IN PARTICULAR BURNER FOR THE COMBUSTION OF LIQUID FUEL IN THE GASEOUS STATE

[75] Inventors: Jörg Füllemann, obere Hauser, CH-7302 Mastrils; Heinrich Boner, Malans, both of Switzerland

[73] Assignee: Jörg Füllemann, Mastrils, Switzerland

[21] Appl. No.: 946,190

[22] Filed: Dec. 23, 1986

[30] Foreign Application Priority Data

Dec. 30, 1985 [CH] Switzerland ..... 5568/85

[51] Int. Cl.[4] ..... F23J 5/02

[52] U.S. Cl. ..... 431/89; 431/116; 431/168; 431/208; 431/265; 239/214.25

[58] Field of Search ..... 431/89, 115, 116, 168, 431/169, 265, 208; 239/214, 214.25, 215, 410, 411

[56] References Cited

U.S. PATENT DOCUMENTS

| | | | |
|---|---|---|---|
| 1,648,923 | 11/1927 | Warrick | 431/168 |
| 3,021,892 | 2/1962 | Brola | 431/116 |
| 3,640,673 | 2/1972 | Okamoto et al. . | |
| 4,421,475 | 12/1983 | Frick . | |

FOREIGN PATENT DOCUMENTS

| | | |
|---|---|---|
| 0067271 | 12/1982 | European Pat. Off. . |
| 0136522 | 4/1985 | European Pat. Off. . |
| 0166329 | 1/1986 | European Pat. Off. . |
| 628724 | 11/1977 | Switzerland . |

*Primary Examiner*—Carroll B. Dority, Jr.

*Attorney, Agent, or Firm*—Frishauf, Holtz, Goodman & Woodward

[57] ABSTRACT

The burner has a motor (11), a fuel pump (13) and a fan (15). In the flame tube (81) is a gasification chamber having a gasification chamber housing (75) coaxially located to the flame tube (81), and a housing (75) located at a distance therefrom. The rotor (17) located in the housing (75) can be axially moved with respect to the bearing (29), thereby causing a slot between the axial bearing surfaces (51, 53). Through this slot fuel is ejected into the gasification chamber by the rotation of the rotor (17). The opening of the slot between the axial bearing surfaces (51, 53) depends on the oil pressure which is determined by signals of the heating control 24. The fuel throughput may be controlled in steps or continuously according to the heat requirements. The electric heating (77) is only used during the start phase. In operation of the burner the heat requirements for the gasifying chamber (25) are covered by the recirculation of hot combustion gases through the recirculation gas inlet (73).

23 Claims, 3 Drawing Figures

BURNER, IN PARTICULAR BURNER FOR THE COMBUSTION OF LIQUID FUEL IN THE GASEOUS STATE

The present invention relates generally to a burner, in particular a burner for the combustion of liquid fuel in the gaseous state, having a motor to drive a fan and/or a fuel pump; a gasification chamber formed by a housing, said gasification chamber being provided with at least one heatable wall; rotatable means located in the gasification chamber, said rotatable means having a drive shaft coupled to the motor; a sleeve enclosing the drive shaft and serving as fuel supply means into the gasification chamber.

BACKGROUND

Such a burner is described in the European Pat. No. 0 136 522, and corresponding U.S. Pat. No. 4,421,475, Frick. A distinction is made between atomizing burners and gasification burners. Atomizing burners atomize the fuel with a nozzle, and combustion takes place in a combustion chamber into which air is supplied. Because the amount of fuel atomized by a nozzle can only be varied within close limits, atomizing burners have the disadvantage that their heat supply cannot be continuously controlled. They cannot be built for very small heat requirements. The smallest nozzles are dimensioned for an oil throughput of approximately 1.4 kilograms per hour. Because the throughput of atomizing burners cannot be continuously varied, atomizing burners are intermittently operated when the heat requirement is small. Because the operating intervals cannot be made arbitrarily short, relatively large boilers are required as heat storage means. The intermittent operation has the disadvantage that repeated switching-on-and-off of the burner causes strong temperature change strains of the material and a high load of soot and noxious substances for boiler, chimney, and environments. Incomplete combustion and generation of soot occuring in particular during the start phase are detrimental to the overall efficiency of a heating system. In addition radiation losses of large boilers further diminish the total efficiency.

In contrast to atomizing burners gasification burners have generally the advantage that they can be regulated according to the heat requirements down to very small heating rates. In addition, combustion of gasified fuel provides a substantial decrease of the emission of noxious substances, e.g. unburned hydrocarbons, and soot.

In spite of the many advantages of gasification burners not much use of them is made. One reason for this is the fact that most gasification burners require much maintenance. Gasification burners generally tend to generate undesired deposits in the gasification chamber. These deposits quickly have a detrimental influence on gasification and therefore the operation of the burner.

In the European Pat. No. 0 036 128 a gasification burner with an electrically heatable gasification chamber is described. The temperature of the gasification chamber is measured by a temperature sensor and is kept by a control device on a optimal value to prevent carbonisation of fuel. A further feature to prevent carbonisation consists in that no air inlets into the gasification chamber are provided. In addition a rotatable devide in form of a wiper is located in the gasification chamber. This wiper serves to distribute the fuel evenly on the heated walls of the gasification chamber and to prevent the formation of deposits so that no detrimental influence of deposits on the evaporation of the fuel can occur. The gas formed in the gasification chamber exits through a nozzle with a relatively high velocity. The air required for combustion is provided by a fan. A modified form of this gasification burner is described in the aforementioned European Pat. No. 0 136 522, Frick.

The burners described in these citations have the disadvantage that they require relatively much electrical energy for the evaporation of the fuel. Burners of this kind are also relatively expensive, because they require a temperature sensor and a temperature control. Compared with other gasification burners where a mixture of fuel and air takes place in the gasification chamber prior to combustion, the combustion of the gas flowing with a relatively high velocity from a nozzle has the disadvantage that relatively high noises are generated. In addition, cold start problems may occur, because the air is not or only little heated prior to combustion. Further it is of disadvantage that on switching-off smoldering of gasified fuel with a sooty flame may take place, if no costly measures have been taken to prevent the further release of gasified fuel from the pressurised gasification chamber.

The European Pat. No. 0 067 271, Noack, discloses an oil burner which can be continuously controlled. It is provided with an electrically heated evaporation device controlled by a thermostat. The evaporation device has the form of a beaker, the bottom of the beaker being provided with air inlet openings. In the beaker is a rotatable cylinder for the distribution of fuel. This cylinder fully occupies the evaporation chamber of the beaker with the exception of a small slot. To distribute oil, oil is fed into the rotating cylinder through a hollow drive shaft. The oil is then ejected through radial bores in the rotating cylinder to the inner walls of the evaporation chamber. However, oil burners of this kind have not found commercial application. Of disadvantage is that the evaporation chamber tends to become dirty. This hinders the entry of air and the exit of the mixture of air and gas. Because the pressure difference between air inlet and the outlet of the air/gas mixture is very small, a small amount of dirt is already sufficient to cause a sooty flame. A further disadvantage consists in that much heat is transferred to the surface of the rotating cylinder and further transferred over the drive shaft to the drive motor. Accordingly, the drive motor can be damaged if not costly devices for its protection are provided. The necessity of thermostat control of the evaporator means further increases the cost of the burner.

The U.S. Pat. No. 3 640 673, Okamoto, describes a burner for a kerosene stove on which a fan is located in the gasification chamber which is heated electrically or by the flame of the burner. Between the periphery of the fan and the heated walls of the gasification chamber there is a relatively large space. On the drive shaft for the fan is an atomizer plate for the fuel. If in operation fuel is directed on the atomizer plate, the fuel is distributed into fine droplets which are splashed outwardly. Thereby the droplets are mixed by the ventilator with the heated air flowing into the gasification chamber. Because the distance between the periphery of the fan and the heated walls of the gasification chamber is relatively large, most fuel droplets are evaporated without getting into contact with a wall. The few droplets which are hitting the heated wall are evaporated there. It is a disadvantage that at the walls deposits are formed which are detrimental to the evaporation, in particular during the start-up, when the gasification chamber is only electrically heated. This may cause start problems. A further disadvantage of the burner consists in that it is practically an atmospheric burner and therefore not suitable for use on a boiler.

In the European application No. 0 166 329, Füllemann, which was published on Jan. 2, 1986, a rotor provided with blades is described. The blades of this rotor extend close to the heated walls of the gasification chamber. The gasification chamber has an air inlet. The fuel fed through the hollow rotor shaft is finely distributed by the rotor and mixed with compressed air. In this way the fuel is evaporated in the hot gasification chamber. The mixture can then exit with relatively high pressure through the openings of a burner plate and burn with a practically noise-free blue flame.

For the sake of completeness it is referred to the oil burner described in the Swiss Pat. No. 628 724, Buschulte. This burner is an atomizing burner but also has features of a gasification burner. However, it has the disadvantage of atomizing burners that it cannot be regulated according to the heating requirements. Also at the lowest throughput it still requires 1.2 to 2.1 kilogram fuel per hour. To provide evaporation of the atomized fuel droplets, a mixing tube and a flame tube are located coaxially to the nozzle. In operation the fuel is sprayed by a nozzle into the mixing tube into which also the air necessary for combustion is fed. At the end of the mixing tube a flame is formed. A part of the hot combustion gases is then recirculated to the beginning of the mixing tube where it is mixed with the fuel mist/air mixture for the purpose of exchanging heat. Thanks to recirculation of a part of the combustion gases this burner permits a substantial evaporation of the oil droplets in the mixing tubes and therefore a better combustion with lower soot formation. However, as already been mentioned, this burner cannot be regulated within a wide range according to the heating requirements and requires in the lower range a still relatively high fuel throughput. Additional problems are caused during the start and the shut-off. This is still more detrimental, because the burner must be intermittently operated. During the start the mixing tube is cold and therefore has no evaporating action. Therefore the flame is very sooty until the mixing tube reaches a high temperature and is in a position to evaporate the arriving fuel. When the burner is switched-off a smoldering with a very sooty flame takes place of the oil dropping from the nozzle. Because on switching-off the mixing tube close to the nozzle is still glowing red, it radiates much heat against the nozzle which may cause carbonisation of fuel in the nozzle. This may cause the nozzle, particularly if it is a small nozzle, to clog.

SUMMARY OF THE INVENTION

It is the object of the present invention to create a burner of the kind described at the beginning but not having part or all of the disadvantages described. The burner should permit an operation with low throughputs of fuel or an adaption of the throughput according to the heating requirements. In addition the burner should provide safe operation and require only little maintenance.

According to the invention this is obtained on a burner of the kind described at the beginning in that the first axial bearing surface is provided by the end of the sleeve located proximate to the gasification chamber, that the rotatable means provide a second axial bearing surface, and that actuating means are provided to move the two axial bearing surfaces apart from each other or toward each other to supply fuel into the gasification chamber according to the heating requirements, or to stop fuel supply.

Accordingly, the burner does not require a nozzle and therefore does not have the disadvantages connected therewith, such as the danger of clogging, impossibility of varying throughput, or of operation at very low throughput, incomplete combustion and formation of soot, etc. Because of the rotating axial bearing surface a good distribution of the fuel in the gasification chamber is obtained which provides for complete gasification of the fuel. The fuel supply rate can be controlled in a simple way by the supply pressure.

Because in operation a relative motion takes place between the axial bearing surfaces there exists no danger of clogging. On switching-off the burner smoldering is prevented, because the axial bearing surfaces are touching each other and are not permitting an exit of fuel. A very simple design is possible which does not require high precision parts such as fuel nozzles. Because on switching-off the axial bearing surfaces rub on each other a selfcleaning takes place.

Preferably the actuating means comprise hydraulic means and a spring. This permits a simple design which is safe in operation. The hydraulic means are preferably formed by a recess adjacent to an axial bearing surface. In operation, fuel may therefore flow into said recess and provide a pressure which causes the axial bearing surfaces to move apart and permit the exit of fuel. This design is very simple and cheap.

The spring is preferably a helical spring located in the space between the drive shaft and the sleeve, said helical spring resting with one end at a flange or a setting ring of the drive shaft and with the other end at a slip ring which itself rests on a shoulder of the sleeve. This provides a simple design of the actuating means. This design is also safe in operation and provides lubrication of the slip ring with fuel. However, it would also be possible to locate the helical spring and the other elements in a space where they are not in a fuel bath.

Preferably the end of the sleeve located proximate to the gasification chamber is formed by a ceramic tube. This tube can also be used as bearing for the drive shaft of the rotating means. Such a design is of advantage, because in this region relatively high temperatures may occur.

At the periphery of the second axial bearing surface preferably a spray rim is located. On rotation this permits a easy separation of the fuel droplets and facilitates therefore a fine distribution of the fuel. While it would be possible to provide the gasification chamber as a closed chamber without air inlets, according to a embodiment of the invention the gasification chamber comprises in the region of the sleeve enclosing the drive shaft an air inlet. The mixture of fuel and air prior to combustion provides quiet operation of the burner. In addition, the air supply close to the drive shaft provides cooling of the drive shaft and therefore protection of bearing and motor. Preferably a recirculation inlet is located at the air inlet. Air inlet and recirculation gas inlet may be arranged coaxially. In this way a recirculation of hot gases is provided by which the housing of the gasification chamber and the gasification chamber itself is heated. This has the advantage that after the start phase no electric heating is required. The heat for gasification is provided by the flame. The strong heating of the housing of the gasification chamber prevents deposits. The Leidenfrost effect prevents contact of the microscopically small fuel droplets with the hot walls. The oil droplets dance on a sort of air cushion until they are completely evaporated. The strong heating of the gasification chamber walls can be facilitated by the location of the recirculation gas inlet at the periphery of the air inlet. An electric heating for the start phase is preferably located on the wall of the gasification chamber housing at the recirculation gas inlet. Because immediately after forming a flame a recirculation of hot gases takes place, the electric heating may be dimensioned relatively small and may be switched-off shortly after the start. The housing of the gasification chamber is preferably formed by a cylindrical or conical tube. This provides an especially simple and cheap design of the housing. The inner surface of the tube is preferably provided with a surface increasing insert, e.g. a metal gauze. This facilitates evaporation of the fuel.

While it would be possible that the rotatable means in the gasification chamber comprise only the described second axial bearing surface to provide distribution of the fuel, it appears advantageous to design the rotatable means as a rotor having blades extending close to the inner surface of the tube. By such a rotor a better distribution of the fuel will be obtained. Further there occurs an intensive mixture of the fuel with air and a feeding effect for the mixture of fuel and air in addition to the other advantages which are described in the previously cited European Pat. No. 0 136 329. Advantageously, a control device may be provided which is controllable by the heating control. The control device may be e.g. a pressure reducing valve to control the pressure in the fuel line. According to the heating requirements the pressure can be controlled in the range of approximately 0.5 to 5 bar, which corresponds to a change in the heat production by the factor of 10. The variation may be obtained with very simple means in a very simple and safe way. Because an operation is still possible at a throughput of approximately 0.1 kilogram fuel per hour, the burner may also be used where up to the present time burners were used having a dish on which the oil is burned. Such burners operate with a sooty flame and generate gases strongly loaded with noxious substances. Such burners are also not very reliable in operation and require much maintenance. Until now a replacement of such prior art burners by reliable burners corresponding to environmental standards was an old but unfulfilled desire.

It is possible to locate near the end of the sleeve located near the motor a further bearing, and on the side of the further bearing distant from the motor a connector for the pressure side of the fuel pump and on the other side of said further bearing a connector for the suction side of the fuel pump. In this way oil leaking through said further bearing may be steadily removed. In this way there occur no leakage problems.

A particular simple embodiment of the invention is characterized in that the sleeve comprises two bearings spaced from each other for supporting the drive shaft, a space being provided between the bearings, said space serving as fuel duct, in that a connector for the fuel supply is provided, and in that a duct from said space to the recess in the axial bearing surface is provided. This provides a very simple design. This simple design is especially suitable for low operating pressures. On low operating pressures there are hardly any leakage problems, so that there is no necessity for a design providing a connection to the suction side of the fuel pump.

The control device controlled by the heating control is preferably a so-called volustat. A volustat is a device which according to an input signal provides a corresponding fuel rate, which is practically not influenced by a resistance in the supply line. The fuel rate is also practically not influenced by the viscosity of the fuel. If a volustat is used, it is possible, to keep the force, which is used to move the axial bearing surfaces together or apart, small. In other words, it is possible to use a relatively soft spring with a flat spring diagramm. Accordingly, the pressure of the liquid fuel in the sleeve will always be small, so that no sealing problems occur.

It is not necessary to provide special measures, e.g. suction, to provide a good seal. If a volustat is used there will be pressures in the order of approximately 0.3 to 0.8 bar on a fuel consumption from 0.4 to 2.5 kg per hour.

DRAWINGS

An embodiment of the invention will now be described with reference to the drawing.

DETAILED DESCRIPTION

Figure 1:
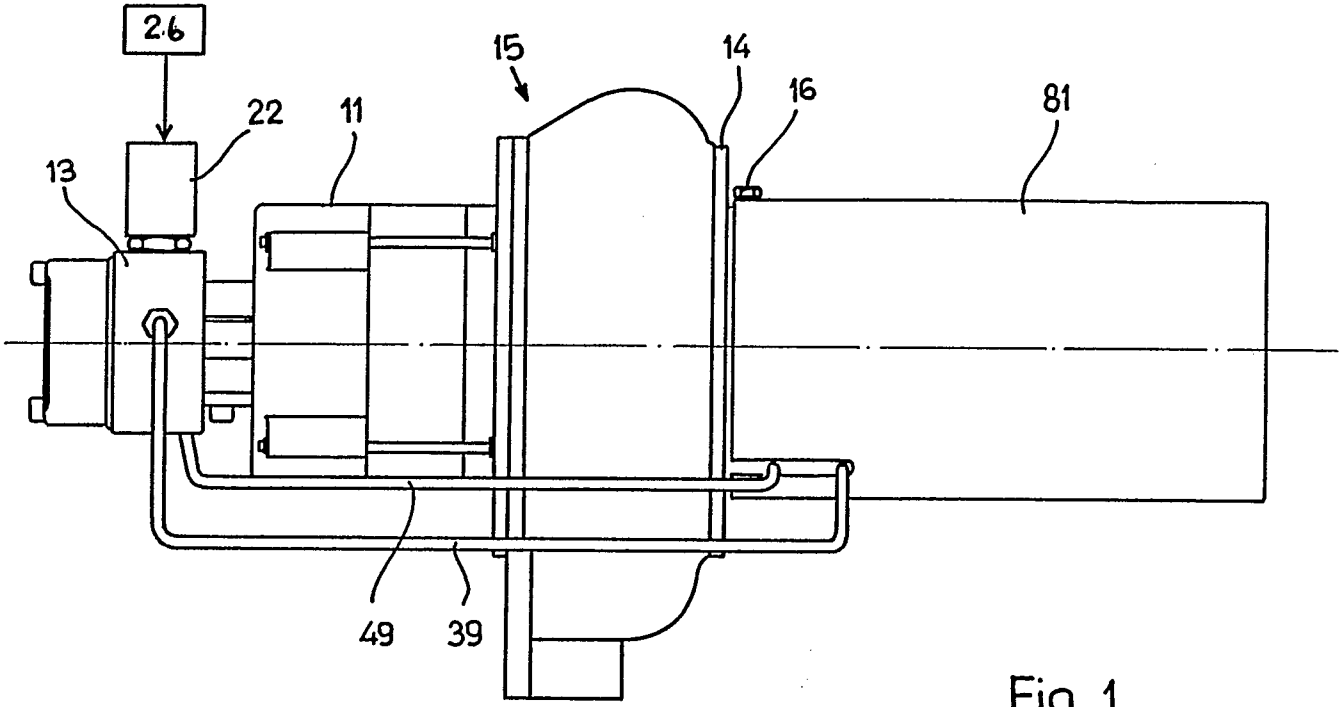
FIG. 1 shows a view of the burner.

The burner shown in the drawing has a motor 11 to drive the fuel pump 13, the fan 15, and the rotatable device 17. The rotatable device 17 is part of an easily exchangeable unit 12. The rotatable device 17 is connected by the drive shaft 19 and the coupling 21 to the motor shaft which is not seen in the drawing. A sleeve 23 surrounding the drive shaft 19 serves as means for supplying fuel to a gasification chamber 25. On the embodiment shown the sleeve 23 is formed by an adapter sleeve 27 and a ceramic tube 29 inserted into the adapter sleeve 27 on the side of the gasification chamber 25. By means of a screw 31 the ceramic tube 29 is fastened to the adapter sleeve 27. The ceramic tube also serves as bearing for the drive shaft 19. Instead of the parts 27 and 29 the sleeve 23 could also consist of an integral metal piece. However, a ceramic bearing 29 has the advantage that it is very temperature resistant and can withstand the high temperatures of the gasification chamber 25. A further bearing 33 for the drive shaft 19 is located at the end of the adapter sleeve 27 proximate to the motor 11.

In front of this bearing 33 is a seal ring 35. At a distance behind the bearing 33 is a seal 37.

From the pressure side of the fuel pump 13 a fuel line 39 leads to the connector 41 leading to the space 43 between the two bearings 29 and 33. A further connector 45 serves to suck leaking oil from the space 47 between the bearing 33 and the seal 37. From the connector 45 a tube 49 leads to the suction side of the fuel pump 13.

It is of importance that on the ceramic tube 29 as well as on the rotatable device 17 axial bearing surfaces 51, 53, respectively, are provided, and that actuating means are provided to move these axial bearing surfaces 51, 53 apart from each other or toward each other to supply fuel from the sleeve 23 into the gasification chamber 25 according to the heating requirements. As actuating means serves a recess 55 in an axial bearing surface 53 and a helical spring 57 in the space 43 between the drive shaft 19 and the adapter sleeve 27. One end of the helical spring 57 abuts on the setting ring 59 which is mounted with a screw 61 on the drive shaft 19. The other end of the helical spring 57 abuts on a slip ring 63 which itself rests on a front face of the bearing 29. The helical spring 65 serves to press the seal ring 35 to the bearing 33.

The helical spring 57 acts on the setting ring 59 and urges therefore the axial bearing surface 53 against the axial bearing surface 51. As long as this pressure is large enough, no fuel may flow into the gasification chamber 25. However, if the fuel pressure in the chamber formed by the recess 55 is large enough it moves the device 17 against the force of the spring 57 in axial direction to the right so that both axial bearing surfaces 51 and 53 are moved apart and a slot is opened through which the fuel may flow into the gasification chamber 25. The higher the pressure in the fuel line 39 the more the slot is opened and the more fuel is flowing into the gasification chamber 25. To permit such a flow a slot 67 extends in axial direction from the room 43 to the recess 55 in the device 17. Because the device 17 rotates in operation, the centrifugal force ejects the fuel droplets with high velocity in radial direction into the gasification chamber 25. The spraying of the fuel is facilitated in that at the periphery of the axial bearing surface 51 a spray rim 69 is provided.

In the neighbourhood of the bearing 29 the gasification chamber 25 has an annular air inlet 71. Located coaxially to this air inlet 71 is an annular recirculation inlet 73 through which the hot combustion gases from the flame may recirculate back into the gasification chamber 25. At the recirculation inlet 73 an electrical heating 77 is located on the wall of the gasification chamber housing 75. The housing 75 is formed by a cylindrical or conical tube 75. The inside of this tube 75 is provided with an area increasing insert, e.g. a metal gauze. This facilitates evaporation of the fuel. Coaxially and at a distance to the combustion chamber 25 a flame tube 81 is provided. The flame tube 81 is divided by a ring 83 into a front section 85 and a rear section 87. In the front section which forms the actual flame tube a tubular insert 89 of heat insulating ceramic fibers is provided.

A support 93 is located on the adapter sleeve 27 by means of screws 91. The support 93 carries the ignition electrode 95 and the air aperture plate 96. In the air aperture plate 96 the air aperture 71 is provided. Between the air aperture plate 96 and the ring 83 which is connected to the flame tube 81 there is a heat resistant seal 91'. On the embodiment shown, the rotatable device 17 is a rotor provided with blades 98. The blades 98 extend close to the inner wall of the housing 75. They cause a good mixture of fuel, air, and recirculated gas. The mixture compressed by the blades 98 can flow through an annular opening 99 between the housing 75 and the rotor 17.

The rotor 17 is mounted by means of a screw 18 at the end of the drive shaft 19. The end of the rotor 17 is covered by a plate 20.

From the drawing can be seen that the flame tube 81 can easily be removed by removing the screws 16 from the fan housing 14. After removing the connectors 41, 45 of the fuel lines and the screw 24, also the unit 12 can be removed. This unit 12 comprises substantially the sleeve 23 with the whole mechanical unit, the gasifying chamber 25 and the ignition electrode 95.

Means controlled by the heating control 26 are provided to control the supply of fuel. Commercial fuel pumps normally have a device. e.g. a pressure reduction valve, with which the desired pump pressure can be manually set. On the embodiment of the burner shown instead of manual setting means a control device is provided. The control device 22 comprises an actuator and said device to set the pump pressure. The control device 22 is operated by the heating control 26. In the simplest case the actuator is a solenoid with which the pump pressure may be changed according to the heat requirements from e.g. two bar to four bar. In this case the burner operates as a two-stage burner. If two solenoids are used, four different stages are possible. However, if a motor is used it is possible to change the pump pressure without steps from e.g. 0.5 to 5 bar.

OPERATION

The burner operates as follows:

For the start the heating control 24 switches-on the electric heater 77 for approximately two minutes. During this time the heater 77 and the insert 79 are heated to a temperature of approximately 550° C. After this preheating time the actual start phase begins in a substantially similar way as on a atomizing burner.

The pressure of the fuel in the recess 55 causes a force which tends to move the rotor 17 in axial direction against the force of the helical spring 57, so that a slot opens between the axial bearing surfaces 51 and 53. Through this slot fuel is ejected into the gasification chamber 25. When the fuel droplets hit the hot surface of the insert 79, fuel gas is generated which is mixed with air by the rotor 17. When the mixture exits from the slot 99 it is ignited by the electrode 95, thus immediately causing a blue flame. A part of the hot gases now occuring are aspired by the injector action of the air entering through the air inlet 71 and flow through the space between the housing 75 and the insert 89 to the recirculation gas inlet 73 and through this inlet into the gasification chamber 25. From now on the hot combustion gases supply the necessary heat for the gasification, so that after the start phase the electric heater 77 may be completely switched-off. Because during operation the rotor 17 and the bearing 29 are heated, the fuel is also heated before it is sprayed into the gasification chamber. Accordingly, no additional fuel heater is necessary. The recirculated combustion gases provide for strong heating of all the parts of the gasification means, so that in the presence of oxygen a continuous self-cleaning takes place.

As has been explained before, the fuel throughput can be changed in steps or continuously according to the heating requirements. On switching-off, when the fuel pressure in the line 39 drops, the helical spring 57 provides for an axial movement of the rotor 17 to the left so that the axial bearing surface 53 is again resting on the axial bearing surface 51 so that no fuel can anymore exit. This prevents smoldering.

It should be noted that fuel having possibly leaked from the space 47 is steadily sucked by the line 49. Should the seal 37 become defect, the pump 13 sucks air through the leak, so that the burner will not operate anymore and malfunction will be indicated.

In addition to the modifications already mentioned, different other modifications are possible. For example, it may be possible to use the advantages of a rotor with blades in the gasification chamber without the necessity to design the means for fuel supply in the way as has been described.

FIG. 3

Figure 2:
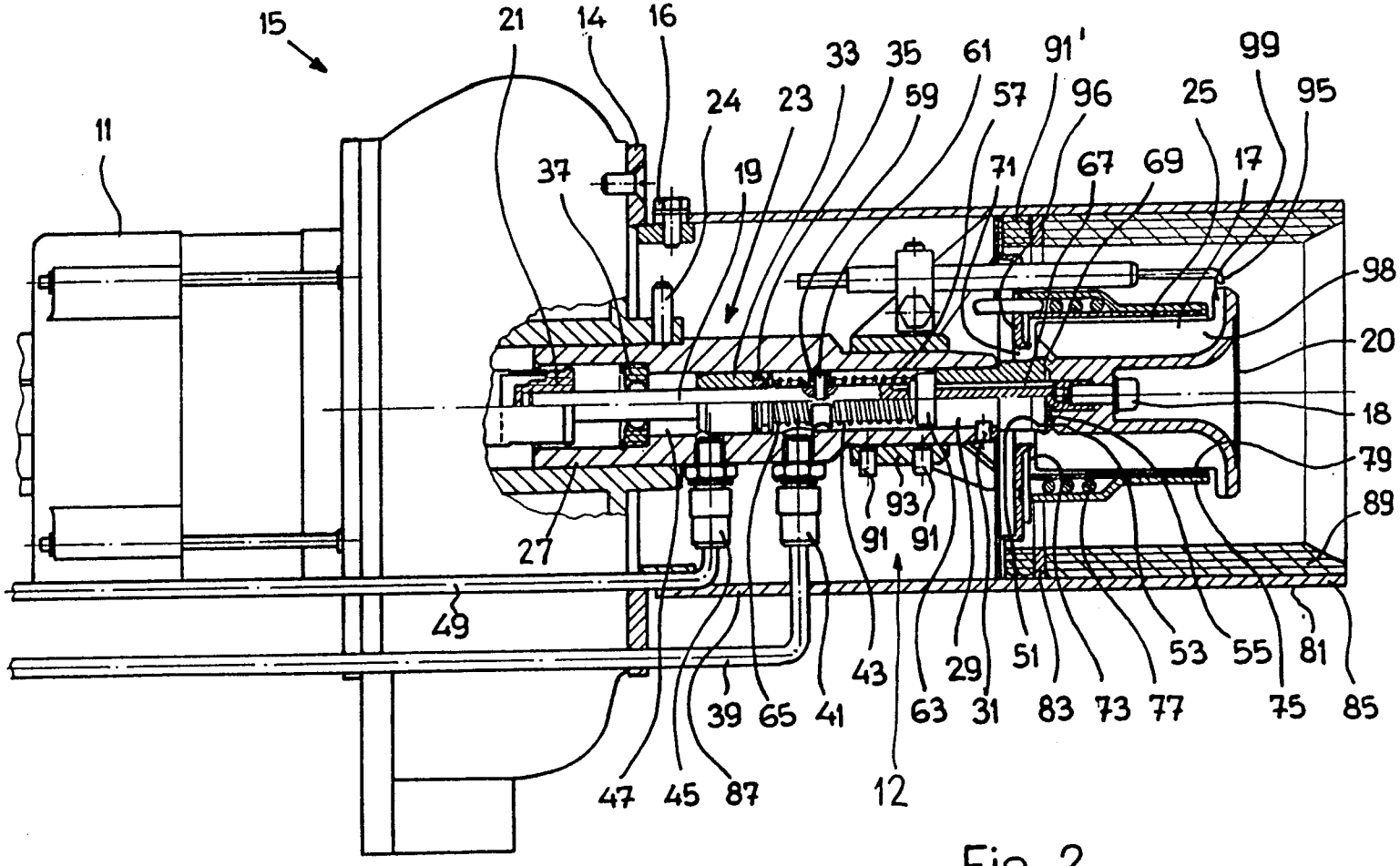
FIG. 2 shows a cross-section through part of the burner of FIG. 1.
Figure 3:
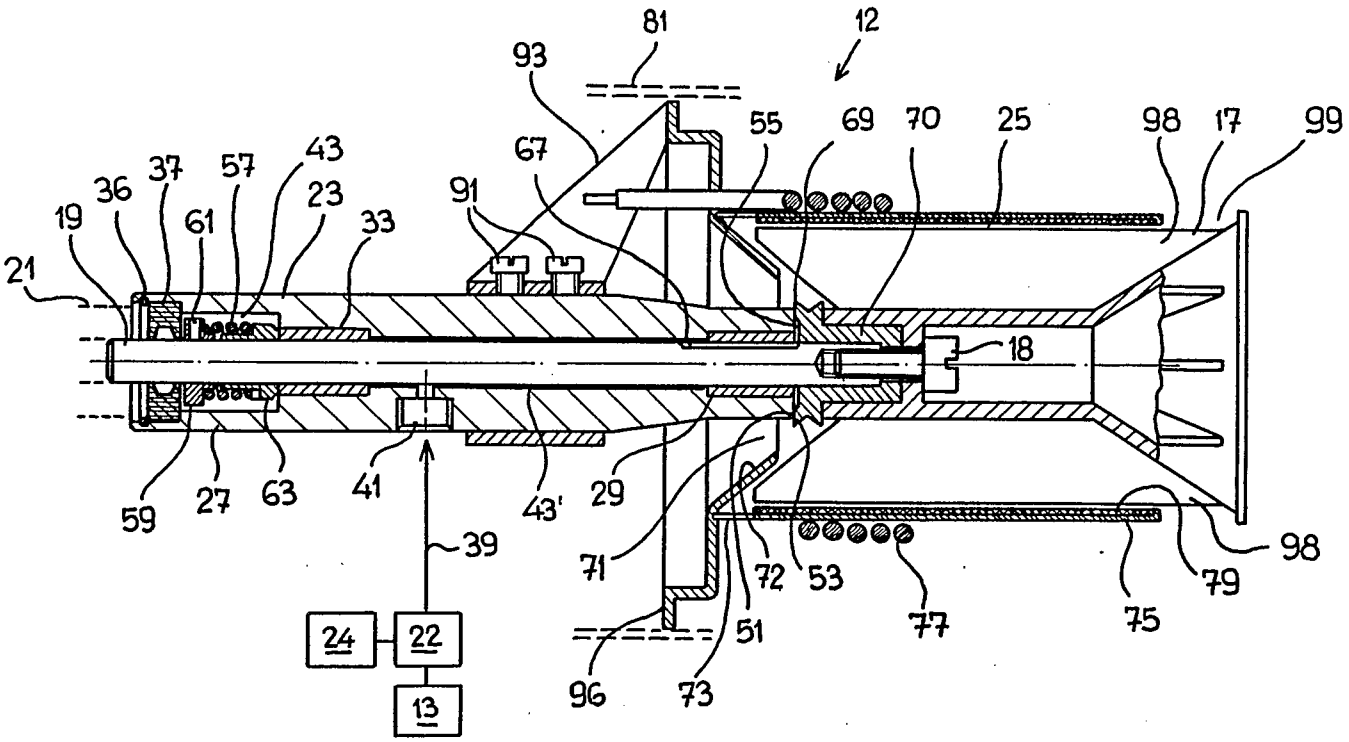
FIG. 3 shows a prefered simplified embodiment of the easy exchangeable unit 12 of FIG. 2.

It has already been stated with reference to FIG. 2 that the flame tube 81 can easily be removed from the fan housing 14 by removing the screws 16. The unit 12 can also be easily removed. FIG. 3 shows a preferred embodiment of the unit 12. This unit is considerably simpler than the unit shown in FIG. 2. Therefore, the unit according to FIG. 3 is substantially cheaper in manufacturing.

On the unit 12 shown in FIG. 3 the rotatable means 17 are again driven by the motor 11 (FIG. 1) of the burner over the drive shaft 19 and the coupling 21. A sleeve 23 surrounding the drive shaft 19 serves as means for supplying fuel to the gasification chamber 25. The sleeve 23 is formed by an adapter sleeve 27 and the bearings 29 and 33. The bearings 29 and 33 consist preferably of a suitable bearing material, e.g. a sinter material. It would also be possible to form the sleeve 23 of a single piece of metal. At the end of the sleeve 23 a lip seal 37 is mounted by means of a spring washer 36.

As schematically indicated a connection 41 is provided to which the fuel line 39 can be connected.

It is again of particular importance that the axial bearing surfaces 51, 53 are provided, and that actuating means are provided to move these axial bearing surfaces 51,53 apart from each other or toward each other to supply fuel from the sleeve 23 into the gasification chamber 25. As actuating means serves the recess 55 in an axial bearing surface 51 and a helical spring 57. One end of the helical spring 57 abuts on the setting ring 59 which is mounted with the screw 61 on the drive shaft 19. The other end of the helical spring 57 abuts on a slip ring 53 which itself rests on a front face of the bearing 33.

The helical spring 57 acts on the setting ring 59 and urges therefore the axial bearing surface 53 against the axial bearing surface 51. As long as this pressure is large enough, no fuel may flow into the gasification chamber 25. However, if the fuel pressure in the chamber formed by the recess 55 is large enough it moves the device 17 against the force of the spring 57 in axial direction to the right so that both axial bearing surfaces 51 and 53 are moved apart and a slot is opened through which the fuel may flow into the gasification chamber 25. To permit such a flow a groove 67 extends in axial direction from the space 43 to the recess 55. Because the device 17 rotates in operation, the centrifugal force ejects fuel droplets with high velocity in radial direction into the gasification chamber 25. The spraying of the fuel is facilitated in that at the rotating part 70 a spray rim 69 is provided. By means of the screw 18 the rotating part 70 is connected together with the device 17 to the drive shaft 19.

The gasification chamber 25 comprises in the region of the bearing 29 an annular air inlet 72. This air inlet is formed by the conic section 72 of the air aperture plate 96. The conical form provides for an advantageous air flow into the gasification chamber 25. This air flow facilitates recirculation of the hot gases. Located coaxially to the air inlet 71 is an annular recirculation inlet 73 through which the hot combustion gases from the flame may recirculate back into the gasification chamber 25. At the recirculation inlet 73 an electrical heating 77 is located on the wall of the gasification chamber housing 75. The housing 75 is formed by a substantially cylindrical tube 75. The inside of this tube 75 is provided with an area increasing insert, e.g. a metal gauze. The flame tube 81 enclosing the unit 12 is shown in FIG. 3 by a pointed line. With respect of the flame tube 81 it is referred to the description of FIG. 2. A support 93 is located on the adapter sleeve 27 by means of screws 91. The support 93 carries the ignition electrode 95 (FIG. 2), not shown in FIG. 3, and the air aperture plate 96.

Also in the embodiment of FIG. 3 the rotatable device 17 is a rotor provided with plates 98.

For the embodiment with the easily removable unit 12 of FIG. 3 preferably a volustat is used as control device 22. A volustat specially designed for oil burners is sold by the firm Satronic AG, CH-8105 Regensdorf, Switzerland. The volustat is a device which according to an applied control signal provides a corresponding fuel rate, that is a certain volume of fuel per time unit. If a volustat is used the spring 57 needs only to provide a closing function when the burner is switched-off. Accordingly, spring 57 may have a flat spring diagram and be relatively soft. Accordingly, only small pressures occur in the sleeve 23. These pressures range from approximately 0.3 to approximately 0.8 bar according to a fuel rate of 0.4 to 2.5 kg per hour. For these pressures a seal 37 is substantially sufficient, so that additional sealing measures as shown on the embodiment of FIG. 2 are generally not required. However, it is evident to the man skilled in the art, that a volustat 22 could also be used in combination with a unit 12 according to FIG. 2.

Tests have shown that the burner according to the invention produces approximately 50 percent less $NO^X$ than normal atomizing burners. It is assumed that this is due to the fact that the combustion does not take place on a relatively small room like on an atomizing burner, but on a relatively large room, so that a relative low flame temperature occurs.

Numerous variations are possible within the scope of the inventive concept.

We claim:

1. A burner comprising a motor (11) to drive a fan (15) and a fuel pump (13); a gasification chamber (25) formed by a housing (75), said gasification chamber (25) being provided with at least one heatable wall; rotatable means (17) located in the gasification chamber (25), said rotatable means (17) having a drive shaft (19) coupled to the motor (11); and a sleeve (23) enclosing the drive shaft (19) and serving as fuel supply means into the gasification chamber (25); characterized in that a first axial bearing surface (51) is provided by the end of the sleeve (23) located proximate to the gasification chamber (25), that the rotatable means (17) provides a second axial bearing surface (53), and that actuating means (55, 57) are provided to move the two axial bearing surfaces (51, 53) apart from each other or toward each other to supply fuel into the gasification chamber (25) according to the heating requirements, or to stop fuel supply.

2. The burner according to claim 1, characterized in that the actuating means comprise hydraulic means (55) and a spring (57).

3. The burner according to claim 2, characterized in that the hydraulic means are formed by a recess (55) adjacent to the axial bearing surface (53).

4. The burner according to claim 2, characterized in that the spring (57) is a helical spring located in the space (43) between the drive shaft (19) and the sleeve (23), said helical spring resting with one end at a flange or setting ring (59) of the drive shaft (19) and with the other end at a slip ring (63) which itself rests on a shoulder of the sleeve (23).

5. The burner according to claim 1, characterized in that at the periphery of an axial bearing surface (51), (53) a spray rim (69) is located.

6. The burner according to claim 1, characterized in that the end of the sleeve located proximate to the gasification chamber (25) is formed by a ceramic tube (29).

7. The burner according to claim 6, characterized in that the ceramic tube (29) is also a bearing for the drive shaft (19) of the rotatable means (17).

8. The burner according to claim 1, characterized in that in the region of the sleeve (23) enclosing in the drive shaft (19) the gasification chamber (25) comprises an air inlet (71).

9. The burner according to claim 8, characterized in that the gasification chamber (25) comprises a recirculation gas inlet (73).

10. The burner according to claim 9, characterized in that the air inlet (71) and the recirculation gas inlet (73) are arranged coaxially.

11. The burner according to claim 10, characterized in that the recirculation gas inlet (73) is located at the periphery of the air inlet (71).

12. The burner according to claim 1, characterized in that, proximate to the recirculation gas inlet (73) an electric heater (77) is located on the wall of the housing of the gasification chamber (25).

13. The burner according to claim 1, characterized in that the housing (75) is formed by a substantially cylindrical tube.

14. The burner according to claim 13, characterized in that the inner surface of the tube (75) is provided with a surface increasing insert, e.g. a metal gauze (79).

15. The burner according to claim 1, characterized in that the rotatable means (17) are provided by a rotor having blades extending close to the inner surface of the tube (75).

16. The burner according to claim 15, characterized in that between the end of the rotor and the housing (75) a slot (99) is provided as an outlet for the gas/air mixture.

17. The burner according to claim 1, characterized in that a flame tube (81) is located coaxially to and at a distance to the gasification chamber (25).

18. The burner according to claim 1, characterized in that a control device (22) is controllable by a heating control (24) to control the supply of fuel.

19. The burner according to claim 7, characterized in that near the end of the sleeve (23) located near the motor, a further bearing (33) is located, and that on the side of the further bearing (33) distant from the motor a connector for the pressure side of the fuel pump (13) is located on the sleeve (23) and that on the other side of said further bearing (33) a connector (45) is provided for the suction side of the fuel pump (13).

20. The burner according to claim 1, characterized in that the sleeve (23) comprises two bearings (29, 33) spaced from each other for support of the drive shaft (19), a space (43') being provided between the bearings (29, 33), said space (43') serving as fuel duct; in that a connector (41) for the fuel supply is provided, and in that a duct (67) from said space (43') to the recess (55) in the axial bearing surface (53) is provided.

21. The burner according to claim 8, characterized in that the air inlet has a conical section (72).

22. The burner according to claim 18, characterized in that control device (22) controlled by the heating control (26) is a volustat.

23. A burner comprising a motor (11) for driving a fan (15) and a fuel pump (13); a gasification chamber (25) formed by a housing (75), said gasification chamber (25) having an air inlet (71) and a recirculation gas inlet (73) and means (23) to supply fuel, characterized in that in the gasification chamber (25) a rotor (17) provided with blades is located, a flame tube (81) surrounding said housing, means for supplying air provided by said fan to said air inlet, and means for recirculating combustion gases from within said flame tube to said recirculating gas inlet.

* * * * *